US008773232B2

(12) United States Patent
Kato

(10) Patent No.: US 8,773,232 B2
(45) Date of Patent: Jul. 8, 2014

(54) HIGH-FREQUENCY TRANSFORMER, HIGH-FREQUENCY COMPONENT, AND COMMUNICATION TERMINAL DEVICE

(71) Applicant: Murata Manufacturing Co., Ltd., Nagaokakyo (JP)

(72) Inventor: Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/705,565

(22) Filed: Dec. 5, 2012

(65) Prior Publication Data

US 2013/0154783 A1 Jun. 20, 2013

(30) Foreign Application Priority Data

Dec. 19, 2011 (JP) ..... 2011-276576

(51) Int. Cl.
*H01F 5/00* (2006.01)
*H01F 27/28* (2006.01)
*H01F 27/24* (2006.01)

(52) U.S. Cl.
USPC ..... 336/200; 336/220; 336/222; 336/234

(58) Field of Classification Search
USPC ..... 336/200, 223, 232, 145, 182, 222, 234, 336/220
See application file for complete search history.

(56) References Cited

U.S. PATENT DOCUMENTS 5,552,756 A * 9/1996 Ushiro ..... 336/200
2006/0158301 A1* 7/2006 Shinkai et al. ..... 336/232

FOREIGN PATENT DOCUMENTS

JP 2002-57042 A 2/2002
WO 2008/105213 A1 9/2008

* cited by examiner

*Primary Examiner* — Alexander Talpalatski
*Assistant Examiner* — Mangtin Lian
(74) *Attorney, Agent, or Firm* — Keating & Bennett, LLP

(57) ABSTRACT

In a high frequency transformer, when a current flows between input-output ports, a magnetic flux produced by first and third coil conductor patterns of a primary coil is interlinked with a second coil conductor pattern of a secondary coil. A magnetic flux produced by the second coil conductor pattern of the primary coil is interlinked with the first and third coil conductor patterns of the secondary coil. The coil conductor patterns are wound so that when a current flows through a transformer, the directions of magnetic fields occurring within the first and third coil conductor patterns of the primary coil and the second coil conductor pattern of the secondary coil are the same and the directions of magnetic fields occurring within the first and third coil conductor patterns of the secondary coil and the second coil conductor pattern of the primary coil are the same.

8 Claims, 13 Drawing Sheets

HIGH-FREQUENCY TRANSFORMER, HIGH-FREQUENCY COMPONENT, AND COMMUNICATION TERMINAL DEVICE

BACKGROUND OF THE INVENTION

1. Field of the Invention

The present invention relates to a high-frequency transformer in which coil elements are coupled to each other with a high degree of coupling, and a high-frequency component and a communication terminal device which including such a high frequency transformer.

2. Description of the Related Art

While a typical high-frequency transformer is formed by wrapping a primary coil and a secondary coil, which are made of metal wires, around a magnetic core made of ferrite or magnetic metal, it has been difficult for such a structure to be miniaturized.

On the other hand, for example, as described in Japanese Unexamined Patent Application Publication No. 2002-057042 or International Publication No. WO 2008/105213, a laminated high-frequency transformer has been known to include a primary coil and a secondary coil, formed by printing a conductor pattern of silver, copper, or other metal in a laminated body formed by laminating ceramic sheets. Since it is possible to manufacture such a laminated type high-frequency transformer using a sheet multilayer process where green sheets in which conductor patterns are printed are laminated and the laminated body thereof is subjected to co-firing, it is easy to manufacture the laminated high-frequency transformer, and it is also possible to miniaturize the high-frequency transformer.

FIG. 13 is a transparent perspective view of a laminated transformer 1 illustrated in International Publication No. WO 2008/105213. As illustrated in FIG. 13, the laminated transformer 1 includes a laminated body 2 and first to fourth external electrodes 3-1 to 3-4. Specifically, a primary coil 4 and a secondary coil 5 are pattern-formed in a predetermined layer of an insulator 6, and the first to fourth external electrodes 3-1 to 3-4 are formed on end surfaces of the laminated body 2.

One shortcoming of the above-described sheet multilayer process is that there is a limit as to available materials which can be used. In other words, it is difficult to make green sheets using a magnetic material whose saturation magnetic flux density or magnetic permeability is high, and it is difficult to subject the green sheets to co-firing along with a conductor pattern material. Therefore, it is difficult to use a magnetic material whose saturation magnetic flux density or magnetic permeability is high, and it is difficult to obtain a high-frequency transformer having a high coupling coefficient and a low loss.

SUMMARY OF THE INVENTION

Preferred embodiments of the present invention provide a high-frequency transformer which is formed using a sheet multilayer process and which has a high coupling coefficient, and a high-frequency component and a communication terminal device including the high-frequency transformer.

According to a preferred embodiment of the present invention, a high-frequency transformer includes a laminated body including a plurality of base material layers that are laminated on one another, and a primary coil and a secondary coil including at least portions thereof that are embedded in the laminated body, wherein the primary coil includes an odd-numbered coil conductor pattern of the primary coil whose coil aperture includes a first axis, and an even-numbered coil conductor pattern of the primary coil, which is series-connected to the odd-numbered coil conductor pattern of the primary coil and whose coil aperture includes a second axis parallel or approximately parallel to the first axis of the primary coil, the secondary coil includes an odd-numbered coil conductor pattern of the secondary coil, whose coil aperture includes the second axis and which is disposed adjacent to the odd-numbered coil conductor pattern of the primary coil, and an even-numbered coil conductor pattern of the secondary coil, which is series-connected to the odd-numbered coil conductor pattern of the secondary coil, whose coil aperture includes the first axis, and which is disposed adjacent to the even-numbered coil conductor pattern of the primary coil, and the odd-numbered coil conductor pattern of the primary coil, the even-numbered coil conductor pattern of the primary coil, the odd-numbered coil conductor pattern of the secondary coil, and the even-numbered coil conductor pattern of the secondary coil are wound such that when currents flow through the primary coil and the secondary coil, directions of a magnetic field occurring in the first axis and a magnetic field occurring in the second axis are opposite to each other.

According to another preferred embodiment of the present invention, a high-frequency component includes a high-frequency transformer, wherein the high-frequency transformer includes a laminated body including a plurality of base material layers that are laminated on one another, and a primary coil and a secondary coil including at least portions thereof that are embedded in the laminated body, wherein the primary coil includes an odd-numbered coil conductor pattern of the primary coil, whose coil aperture includes a first axis, and an even-numbered coil conductor pattern of the primary coil, which is series-connected to the odd-numbered coil conductor pattern of the primary coil, and whose coil aperture includes a second axis parallel or approximately parallel to the first axis of the primary coil, the secondary coil includes an odd-numbered coil conductor pattern of the secondary coil, whose coil aperture includes the second axis and which is disposed adjacent to the odd-numbered coil conductor pattern of the primary coil, and an even-numbered coil conductor pattern of the secondary coil, which is series-connected to the odd-numbered coil conductor pattern of the secondary coil, whose coil aperture includes the first axis, and which is disposed adjacent to the even-numbered coil conductor pattern of the primary coil, and the odd-numbered coil conductor pattern of the primary coil, the even-numbered coil conductor pattern of the primary coil, the odd-numbered coil conductor pattern of the secondary coil, and the even-numbered coil conductor pattern of the secondary coil are wound such that when currents flow through the primary coil and the secondary coil, directions of a magnetic field occurring in the first axis and a magnetic field occurring in the second axis are opposite to each other.

According to another preferred embodiment of the present invention, a communication terminal device includes a high-frequency transformer in a transmission unit of a communication signal, wherein the high-frequency transformer includes a laminated body including a plurality of base material layers that are laminated on one another, and a primary coil and a secondary coil including at least portions thereof that are embedded in the laminated body, wherein the primary coil includes an odd-numbered coil conductor pattern of the primary coil, whose coil aperture includes a first axis, and an even-numbered coil conductor pattern of the primary coil, which is series-connected to the odd-numbered coil conductor pattern of the primary coil, and whose coil aperture includes a second axis parallel or approximately parallel to the first axis of the primary coil, the secondary coil includes an odd-numbered coil conductor pattern of the secondary coil, whose coil aperture includes the second axis and which is disposed adjacent to the odd-numbered coil conductor pattern of the primary coil, and an even-numbered coil conductor pattern of the secondary coil, which is series-connected to the odd-numbered coil conductor pattern of the secondary coil, whose coil aperture includes the first axis, and which is disposed adjacent to the even-numbered coil conductor pattern of the primary coil, and the odd-numbered coil conductor pattern of the primary coil, the even-numbered coil conductor pattern of the primary coil, the odd-numbered coil conductor pattern of the secondary coil, and the even-numbered coil conductor pattern of the secondary coil are wound such that when currents flow through the primary coil and the secondary coil, directions of a magnetic field occurring in the first axis and a magnetic field occurring in the second axis are opposite to each other.

Since a high-frequency transformer according to preferred embodiments of the present invention is configured as described above, a high-frequency transformer having a small leakage magnetic field and a high coupling coefficient between a primary coil and a secondary coil, and a high-frequency component and a communication terminal device equipped therewith are obtained, without using a material whose saturation magnetic flux density or magnetic permeability is high.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A laminated type transformer of a first preferred embodiment of the present invention is a laminated type transformer preferably used for a high-frequency circuit in a communication terminal device or other suitable device, for example, and preferably configured as a chip-type component mountable on a surface of a printed wiring board or other suitable substrate, for example.

Figure 1:
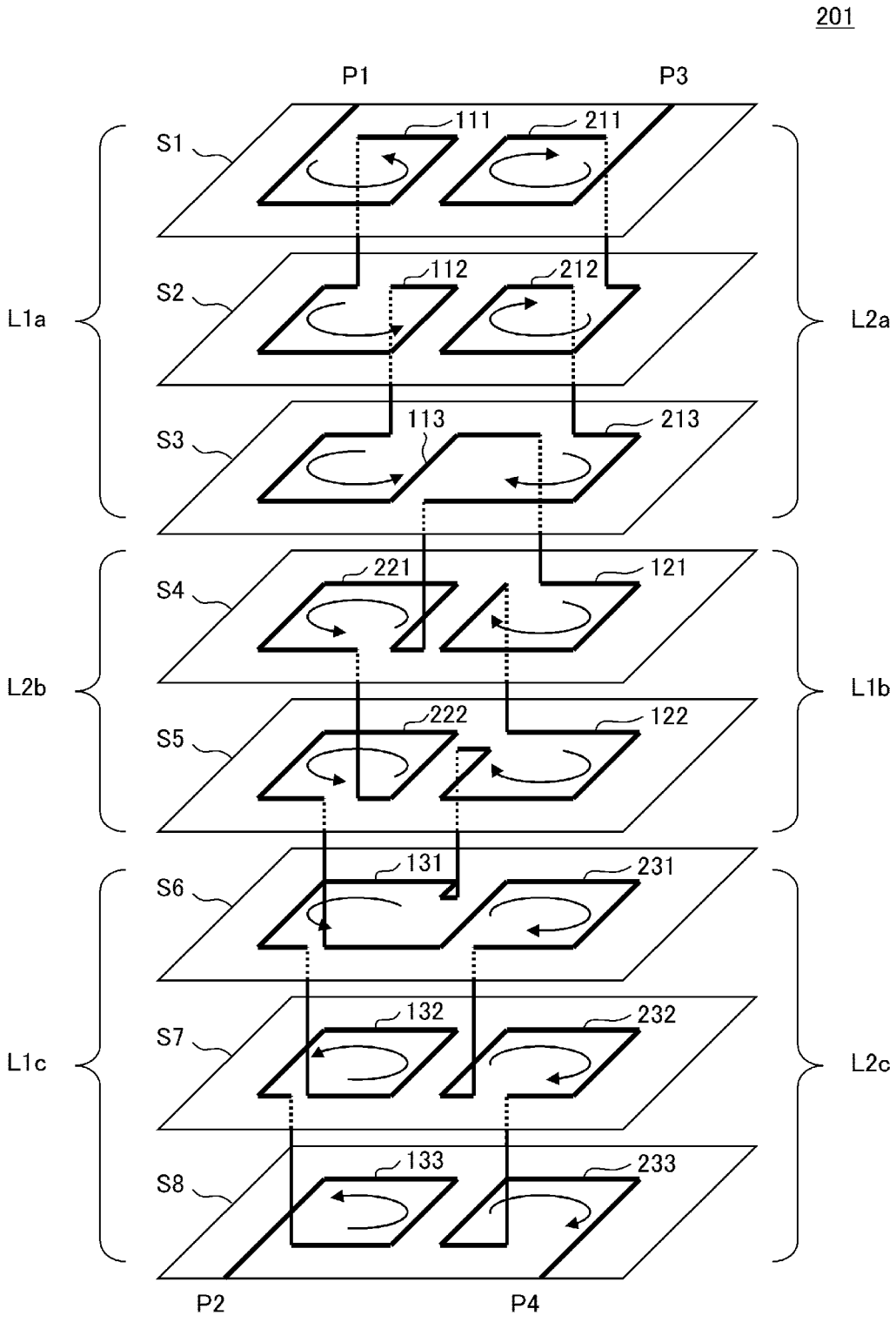
FIG. 1 is an exploded perspective view of a high-frequency transformer of a first preferred embodiment of the present invention.
Figure 2A:
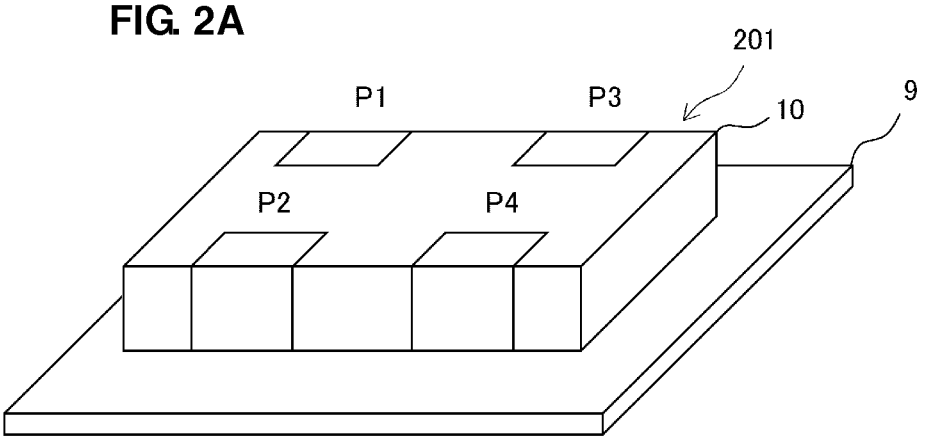
FIG. 2A is a perspective view in a state in which the high-frequency transformer of the first preferred embodiment of the present invention is mounted on a printed wiring board.
Figure 2B:
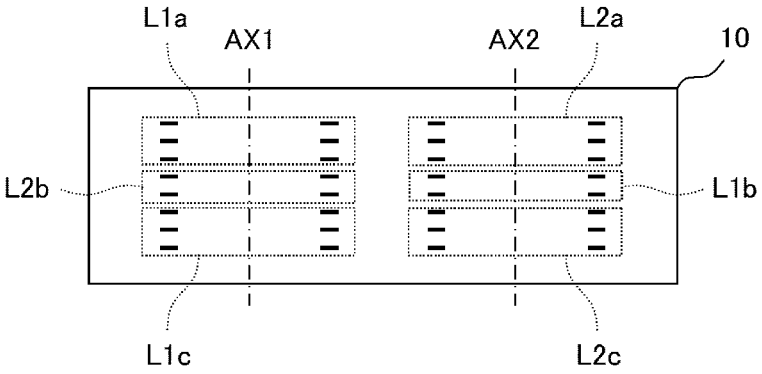
FIG. 2B is a cross-sectional view of the high-frequency transformer.

FIG. 1 is the exploded perspective view of a high-frequency transformer 201 of the first preferred embodiment. FIG. 2A is a perspective view in a state in which the high-frequency transformer 201 of the first preferred embodiment is mounted on a printed wiring board 9. FIG. 2B is the cross-sectional view of the high-frequency transformer 201.

In the high-frequency transformer 201, a primary coil and a secondary coil are provided in a laminated body 10 including a plurality of base material layers S1 to S8 that are laminated to one another and a plurality of conductor patterns provided in the laminated body 10.

As illustrated in FIG. 1, conductor patterns are provided on the base material layers S1 to S8. Conductor patterns 111 to 113 and 211 to 213 are provided on the base material layers S1 to S3. Conductor patterns 121, 122, 221, and 222 are provided on the base material layers S4 and S5. Conductor patterns 131 to 133 and 231 to 233 are provided on the base material layers S6 to S8.

Dashed lines extending in a vertical direction in FIG. 1 denote via hole conductors, and connect conductor patterns to each other using interlayers.

The conductor patterns 111 to 113 and the via hole conductors connecting the conductor patterns 111 to 113 to each other define a first coil conductor pattern L1*a* of the primary coil. In addition, the conductor patterns 121 and 122 and the via hole conductor connecting the conductor patterns 121 and 122 to each other define a second coil conductor pattern L1*b* of the primary coil. In addition, the conductor patterns 131 to 133 and the via hole conductors connecting the conductor patterns 131 to 133 to each other define a third coil conductor pattern L1*c* of the primary coil. In addition, the conductor patterns 211 to 213 and the via hole conductors connecting the conductor patterns 211 to 213 to each other define a first coil conductor pattern L2*a* of the secondary coil. In addition, the conductor patterns 221 and 222 and the via hole conductor connecting the conductor patterns 221 and 222 to each other define a second coil conductor pattern L2*b* of the secondary coil. In addition, the conductor patterns 231 to 233 and the via hole conductors connecting the conductor patterns 231 to 233 to each other define a third coil conductor pattern L2*c* of the secondary coil.

The above-described coil conductor patterns L1*a* and L1*c* correspond to "odd-numbered coil conductor patterns of the primary coil", and the coil conductor pattern L1*b* corresponds to an "even-numbered coil conductor pattern of the primary coil". In addition, the coil conductor patterns L2*a* and L2*c* correspond to "odd-numbered coil conductor patterns of the secondary coil", and the coil conductor pattern L2*b* corresponds to an "even-numbered coil conductor pattern of the secondary coil".

In FIG. 1, the end portion of the first coil conductor pattern L1*a* of the primary coil is used as a port P1, and the end portion of the third coil conductor pattern L1*c* of the primary coil is used as a port P2. In addition, the end portion of the first coil conductor pattern L2*a* of the secondary coil is used as a port P3, and the end portion of the third coil conductor pattern L2*c* of the secondary coil is used as a port P4.

As illustrated in FIG. 2A, external electrodes defining the input-output ports P1, P2, P3, and P4 are provided on an outer surface of the laminated body 10.

As illustrated in FIG. 2B, the coil apertures of the first coil conductor pattern L1*a* and the third coil conductor pattern L1*c* of the primary coil include a first axis AX1, and the coil aperture of the second coil conductor pattern L1*b* of the primary coil includes a second axis AX2 parallel or approximately parallel to the first axis AX1. In addition, the coil apertures of the first coil conductor pattern L2*a* and the third coil conductor pattern L2*c* of the secondary coil include the second axis AX2, and the coil aperture of the second coil conductor pattern L2*b* of the secondary coil includes the first axis AX1.

In the first preferred embodiment, the coil conductor patterns L1*a*, L2*b*, and L1*c* are arranged so that the winding axes of the individual coil conductor patterns substantially coincide with the first axis AX1, and the coil conductor patterns L2*a*, L1*b*, and L2*c* are arranged so that the winding axes of the individual coil conductor patterns substantially coincide with the second axis AX2. In addition, the first axis AX1 and the second axis AX2 are substantially straight lines adjacent to each other and extending substantially in parallel with each other. However, it is not necessary for the first axis AX1 and the second axis AX2 to be exactly parallel to each other, and the first axis AX1 and the second axis AX2 may also be approximately parallel to each other.

In addition, in a first axis AX1 direction, the coil conductor pattern L2*b* is disposed between the coil conductor pattern L1*a* and the coil conductor pattern L1*c*, and in a second axis AX2 direction, the coil conductor pattern L1*b* is disposed between the coil conductor pattern L2*a* and the coil conductor pattern L2*c*. In other words, in the first axis AX1, a coil aperture surface (bottom surface) on one side of the coil conductor pattern L1*a* faces a coil aperture surface (top surface) on one side of the coil conductor pattern L2*b*, and a coil aperture surface (bottom surface) on the other side of the coil conductor pattern L2*b* faces a coil aperture surface (top surface) on one side of the coil conductor pattern L1*c*. In substantially the same manner, in the second axis AX2, a coil aperture surface (bottom surface) on one side of the coil conductor pattern L2*a* faces a coil aperture surface (top surface) on one side of the coil conductor pattern L1*b*, and a coil aperture surface (bottom surface) on the other side of the coil conductor pattern L1*b* faces a coil aperture surface (top surface) on one side of the coil conductor pattern L2*c*.

Since an eddy-current loss is relatively small when a high-frequency transformer for an HF band is produced, a magnetic material (dielectric material having high magnetic permeability) may be used as a material for a base layer, in terms of a confinement property of magnetic energy. On the other hand, for example, when a high-frequency transformer for a UHF band is produced, it is preferable that a dielectric material having high electrical insulation resistance is used so as to reduce an eddy-current loss in a high frequency region. Since a magnetic material, such as ferrite, for example, has the frequency characteristic of magnetic permeability, a loss increases with an increase in an operation frequency band. However, since a dielectric has a relatively stable frequency characteristic, it is possible to produce a laminated type high-frequency transformer whose loss is small in a wide frequency band.

In addition, according to preferred embodiments of the present invention, as described later, since a closed magnetic circuit that is used preferably includes a plurality of coil elements, it is not always necessary to use a magnetic base material, and, using a dielectric body, it is possible to produce a high-frequency transformer having a stable frequency characteristic. A base material layer may preferably be a dielectric ceramic layer, such as Low Temperature Co-fired Ceramics (LTCC), for example, and may also preferably be a resin layer including a thermoplastic resin material, such as polyimide, or a thermosetting resin material, such as epoxy resin, for example. In other words, a laminated body may preferably be either a ceramic laminated body or a resin laminated body.

In addition, it is preferable that a metal material whose main component is a metal, such as copper or silver, for example, whose specific resistance is low, is used for each coil element, a wiring line connecting each coil element, a wiring line connecting each coil element and an external terminal to each other, and other suitable wiring elements.

Figure 3A:
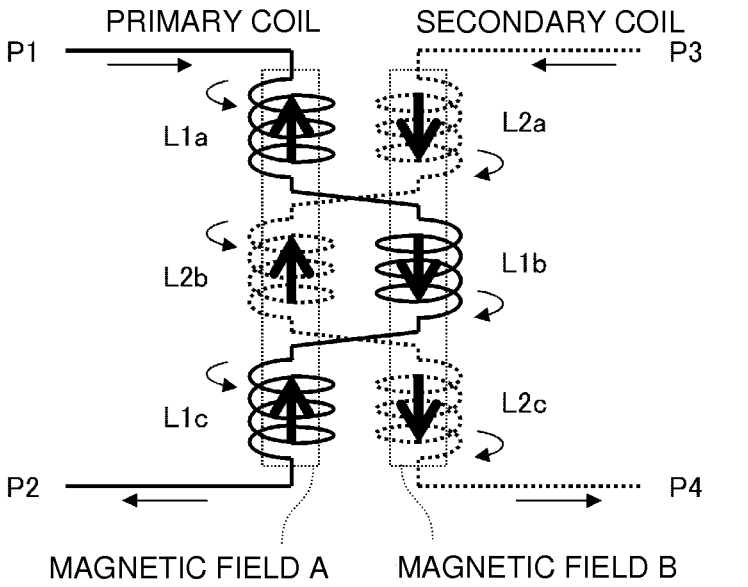
FIG. 3A and FIG. 3B are diagrams illustrating directions of currents flowing through a primary coil and a secondary coil of the high-frequency transformer of the first preferred embodiment of the present invention and directions of magnetic fluxes passing through coil apertures (coil axes) of the primary coil and the secondary coil.
Figure 3B:
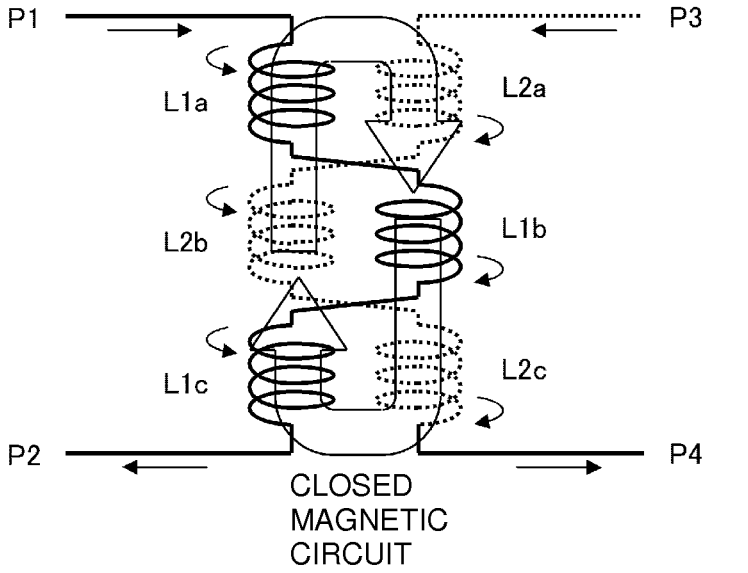

FIG. 3A and FIG. 3B are diagrams illustrating the directions of currents flowing through the primary coil and the secondary coil of the high-frequency transformer of the first preferred embodiment and the directions of magnetic fluxes passing through the coil apertures (coil axes) of the primary coil and the secondary coil.

As illustrated in FIG. 3A, when a current flows between the input-output ports P1 and P2, a magnetic flux produced by the first coil conductor pattern L1*a* and the third coil conductor pattern L1*c* of the primary coil is interlinked with the second coil conductor pattern L2*b* of the secondary coil. In addition, a magnetic flux produced by the second coil conductor pattern L1*b* of the primary coil is interlinked with the first coil conductor pattern L2*a* and the third coil conductor pattern L2*c* of the secondary coil.

In an example of the coil conductor pattern illustrated in FIG. 1, when a current flows in a direction from the input-output port P1 towards the input-output port P2, a counterclockwise current, a clockwise current, and a counterclockwise current flow through the coil conductor pattern L1*a*, the coil conductor pattern L1*b*, and the coil conductor pattern L1*c*, respectively, and induced currents due to the currents individually flow through the coil conductor pattern L2*a* in a clockwise direction, the coil conductor pattern L2*b* in a counterclockwise direction, and the coil conductor pattern L2*c* in a clockwise direction. In other words, as illustrated in FIG. 3A, the individual coil conductor patterns are wound so that when a current flows through the transformer, the magnetic fields (a magnetic field A) occurring within the coil conductor pattern L1*a*, the coil conductor pattern L2*b*, and the coil conductor pattern L1*c* extend in a first common direction and the magnetic fields (a magnetic field B) occurring within the coil conductor pattern L2*a*, the coil conductor pattern L1*b*, and the coil conductor pattern L2*c* extend in a second common direction.

Accordingly, as illustrated in FIG. 3B, magnetic fields occurring within the individual coil conductor patterns produce one large closed magnetic circuit, and even if a material having a large saturation magnetic flux density or large magnetic permeability is not used, a high-frequency transformer having a small leakage magnetic field and a high degree of coupling between the primary coil and the secondary coil is obtained. In addition, since a sheet multilayer process can be used to manufacture the high-frequency transformer, it is easy to manufacture a high-frequency transformer, and obtain a small high-frequency transformer.

In particular, as illustrated in FIG. 2B, in the first axis AX1, the coil conductor pattern L2*b* is disposed between the coil conductor pattern L1*a* and the coil conductor pattern L1*c*, and in the second axis AX2, the coil conductor pattern L1*b* is disposed between the coil conductor pattern L2*a* and the coil conductor pattern L2*c*. Therefore, the degree of coupling between the primary coil and the secondary coil on each axis is high. In addition, since the directions of magnetic fields occurring within the coil apertures of the coil conductor patterns adjacent to each other in each axis direction (along the coil axis) are aligned in the same direction, leakage inductance is small and effective inductance is large. Therefore, the total line length or the number of turns of each coil conductor pattern required for obtaining a predetermined mutual inductance is reduced, and as a result, the size of the transformer can be significantly reduced.

Second Preferred Embodiment

While, in the first preferred embodiment, the primary coil preferably includes three series-connected coil conductor patterns and the secondary coil similarly preferably includes three series-connected coil conductor patterns, a second preferred embodiment of the present invention illustrates an example in which each of a primary coil and a secondary coil preferably includes two coil conductor patterns.

Figure 4:
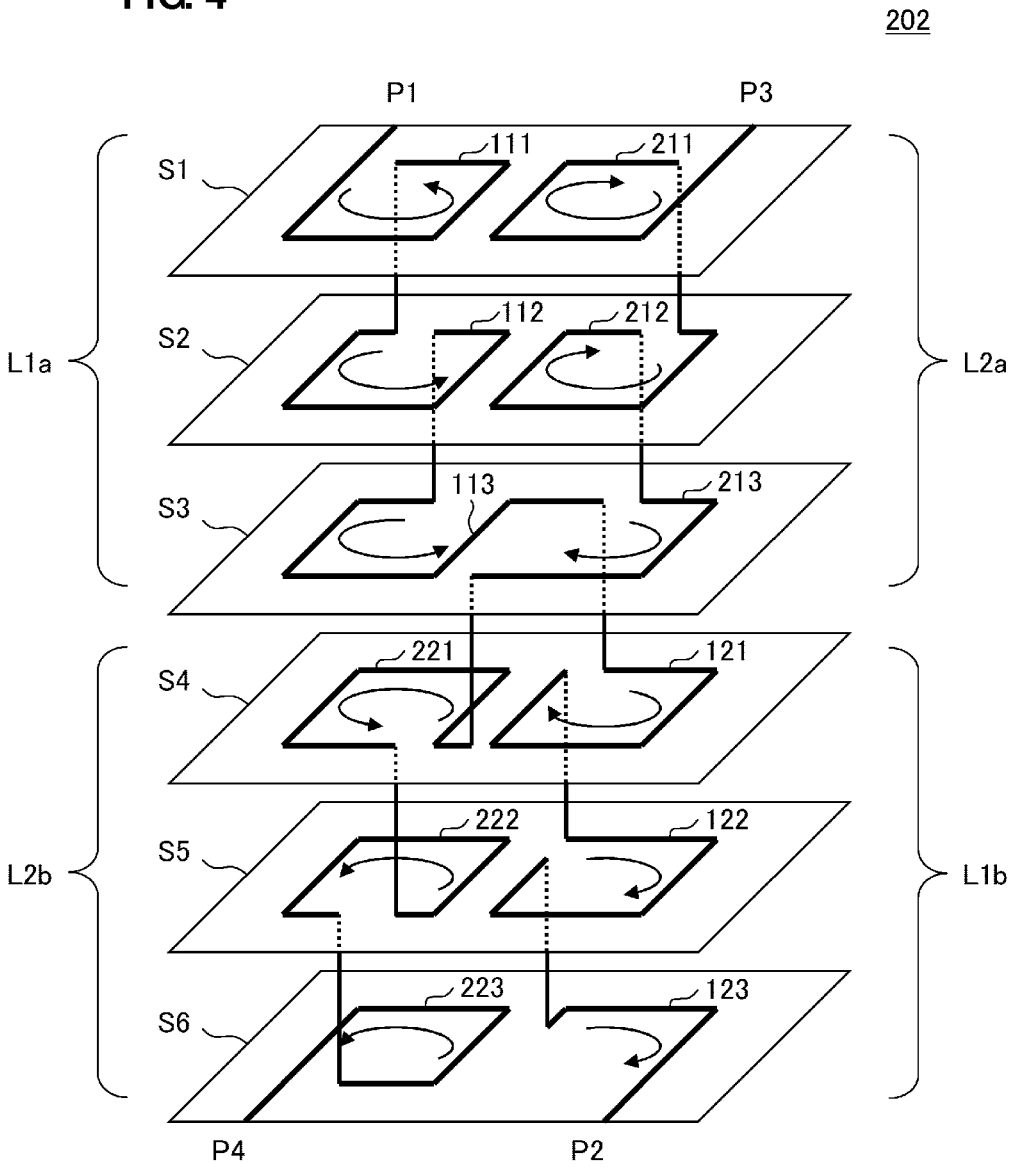
FIG. 4 is an exploded perspective view of a high-frequency transformer of a second preferred embodiment of the present invention.
Figure 5A:
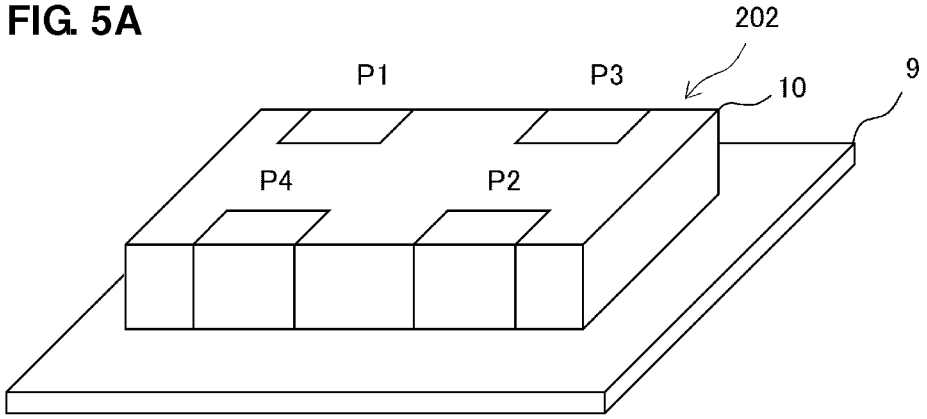
FIG. 5A is a perspective view in a state in which the high-frequency transformer of the second preferred embodiment of the present invention is mounted on a printed wiring board.
Figure 5B:
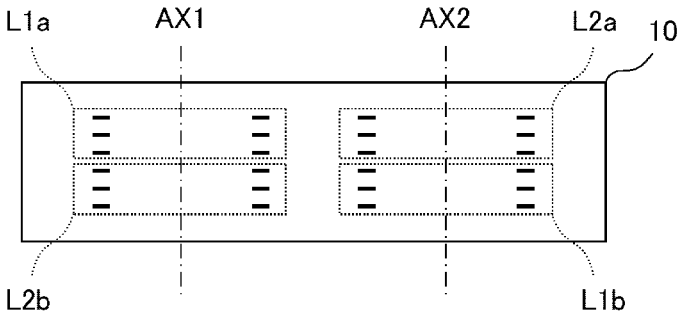
FIG. 5B is a cross-sectional view of the high-frequency transformer.

FIG. 4 is the exploded perspective view of a high-frequency transformer 202 of the second preferred embodiment. FIG. 5A is a perspective view in a state in which the high-frequency transformer 202 of the second preferred embodiment is mounted on the printed wiring board 9. FIG. 5B is the cross-sectional view of the high-frequency transformer 202.

In the high-frequency transformer 202, a primary coil and a secondary coil are provided in a laminated body including a plurality of base material layers S1 to S6 that are laminated to one another and a plurality of conductor patterns provided in the laminated body.

As illustrated in FIG. 4, conductor patterns are provided on the base material layers S1 to S6. Conductor patterns 111 to 113 and 211 to 213 are provided on the base material layers S1 to S3. Conductor patterns 121 to 123 and 221 to 223 are provided on the base material layers S4 to S6.

Dashed lines extending in a vertical direction in FIG. 4 denote via hole conductors, and connect conductor patterns to each other using interlayers.

The conductor patterns 111 to 113 and the via hole conductors connecting the conductor patterns 111 to 113 to each other define a first coil conductor pattern L1*a* of the primary coil. In addition, the conductor patterns 121 to 123 and the via hole conductors connecting the conductor patterns 121 to 123 to each other define a second coil conductor pattern L1*b* of the primary coil. In addition, the conductor patterns 211 to 213 and the via hole conductors connecting the conductor patterns 211 to 213 to each other define a first coil conductor pattern L2*a* of the secondary coil. In addition, the conductor patterns 221 to 223 and the via hole conductors connecting the conductor patterns 221 to 223 to each other define a second coil conductor pattern L2*b* of the secondary coil.

In FIG. 4, the end portion of the first coil conductor pattern L1*a* of the primary coil is used as a port P1, and the end portion of the second coil conductor pattern L1*b* of the primary coil is used as a port P2. In addition, the end portion of the first coil conductor pattern L2*a* of the secondary coil is used as a port P3, and the end portion of the second coil conductor pattern L2*b* of the secondary coil is used as a port P4.

As illustrated in FIG. 5A, external electrodes defining the input-output ports P1, P2, P3, and P4 are provided on an outer surface of the laminated body 10.

As illustrated in FIG. 5B, the coil aperture of the first coil conductor pattern L1*a* of the primary coil includes a first axis AX1, and the coil aperture of the second coil conductor pattern L1*b* of the primary coil includes a second axis AX2 parallel or approximately parallel to the first axis AX1. In addition, the coil aperture of the first coil conductor pattern L2*a* of the secondary coil includes the second axis AX2, and the coil aperture of the second coil conductor pattern L2*b* of the secondary coil includes the first axis AX1.

In the second preferred embodiment, the coil conductor patterns L1*a* and L2*b* are arranged so that the winding axes of both of the coil conductor patterns substantially coincide with the first axis AX1, and the coil conductor patterns L2*a* and L1*b* are arranged so that the winding axes of both of the coil conductor patterns substantially coincide with the second axis AX2. In addition, preferably, the first axis AX1 and the second axis AX2 are substantially straight lines adjacent to each other and extending parallel or substantially parallel with each other. However, it is not necessary for the first axis AX1 and the second axis AX2 to be exactly parallel to each other, and the first axis AX1 and the second axis AX2 may also be approximately parallel to each other.

Figure 6A:
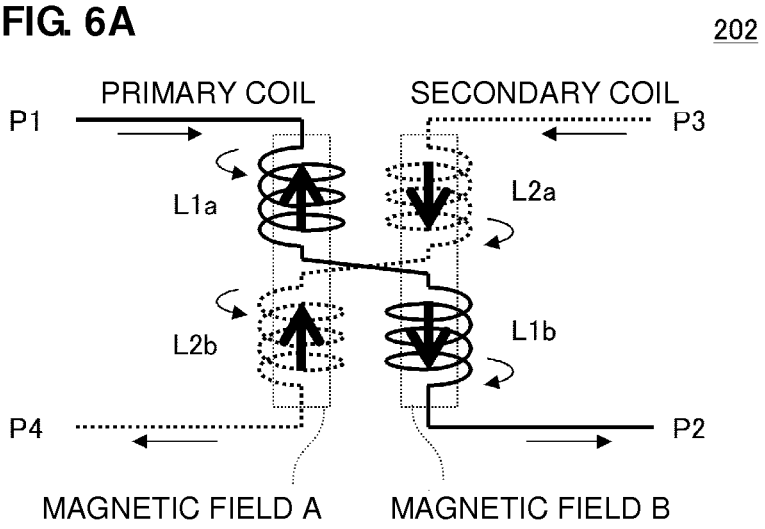
FIG. 6A and FIG. 6B are diagrams illustrating directions of currents flowing through a primary coil and a secondary coil of the high-frequency transformer of the second preferred embodiment of the present invention and directions of magnetic fluxes passing through coil apertures (coil axes) of the primary coil and the secondary coil.
Figure 6B:
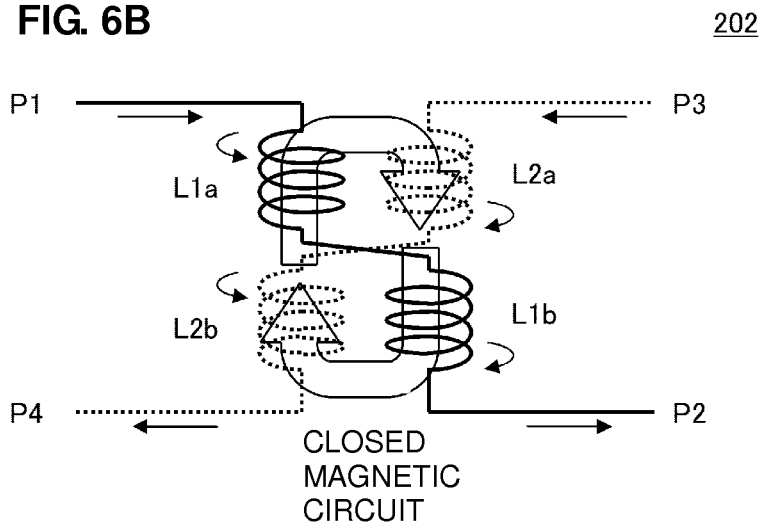

FIG. 6A and FIG. 6B are diagrams illustrating the directions of currents flowing through the primary coil and the secondary coil of the high-frequency transformer 202 of the second preferred embodiment and the directions of magnetic fluxes passing through the coil apertures (coil axes) of the primary coil and the secondary coil.

As illustrated in FIG. 6A, when a current flows between the input-output ports P1 and P2, a magnetic flux produced by the first coil conductor pattern L1*a* of the primary coil is interlinked with the second coil conductor pattern L2*b* of the secondary coil. In addition, a magnetic flux produced by the second coil conductor pattern L1*b* of the primary coil is interlinked with the first coil conductor pattern L2*a* of the secondary coil.

In an example of the coil conductor pattern illustrated in FIG. 4, when a current flows in a direction from the input-output port P1 towards the input-output port P2, a counterclockwise current and a clockwise current flow through the coil conductor pattern L1*a* and the coil conductor pattern L1*b*, respectively, and induced currents due to the currents flow through the coil conductor pattern L2*a* in a clockwise direction and the coil conductor pattern L2*b* in a counter-clockwise direction. In other words, as illustrated in FIG. 6A, the individual coil conductor patterns are wound so that when a current flows through the transformer, the magnetic fields (a magnetic field A) occurring within the coil conductor pattern L1*a* and the coil conductor pattern L2*b* extend in a first common direction and the magnetic fields (a magnetic field B) occurring within the coil conductor pattern L2*a* and the coil conductor pattern L1*b* extend in a second common direction.

Accordingly, as illustrated in FIG. 6B, magnetic fields occurring within the individual coil conductor patterns define one large closed magnetic circuit, and even if a material having a large saturation magnetic flux density or large magnetic permeability is not used, a high-frequency transformer having a small leakage magnetic field and a high degree of coupling between the primary coil and the secondary coil is obtained. In addition, since a sheet multilayer process can be used to manufacture the high-frequency transformer, it is easy to manufacture a high-frequency transformer, and obtain a small high-frequency transformer.

Third Preferred Embodiment

Figure 7A:
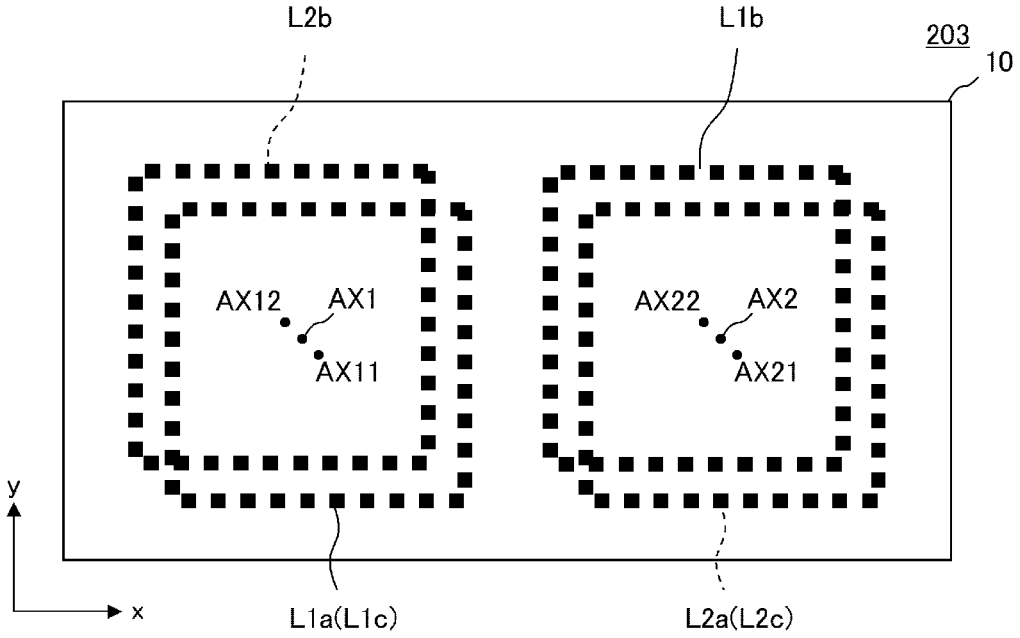
FIG. 7A is a schematic plan view of a high-frequency transformer of a third preferred embodiment of the present invention and a diagram illustrating a positional relationship between coil conductor patterns within a laminated body.
Figure 7B:
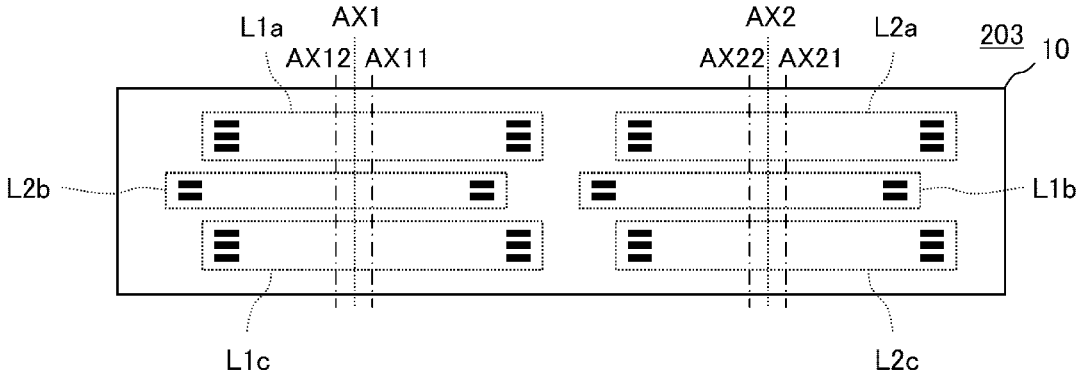
FIG. 7B is a cross-sectional view of the high-frequency transformer.

FIG. 7A is the schematic plan view of a high-frequency transformer 203 of a third preferred embodiment of the present invention and a diagram illustrating a positional relationship between coil conductor patterns within a laminated body. FIG. 7B is the cross-sectional view of the high-frequency transformer 203.

As illustrated in FIG. 7A and FIG. 7B, the coil apertures of the first coil conductor pattern L1*a* and the third coil conductor pattern L1*c* of the primary coil include a first axis AX1, and the coil aperture of the second coil conductor pattern L1*b* of the primary coil includes a second axis AX2 parallel or approximately parallel to the first axis AX1. In addition, the coil apertures of the first coil conductor pattern L2*a* and the third coil conductor pattern L2*c* of the secondary coil include the second axis AX2, and the coil aperture of the second coil conductor pattern L2*b* of the secondary coil includes the first axis AX1.

However, the coil axis AX11 of the first coil conductor pattern L1*a* and the third coil conductor pattern L1*c* of the primary coil and the coil axis AX12 of the second coil conductor pattern L2*b* of the secondary coil are shifted in both of an X axis direction and a Y axis direction. In substantially the same manner, the coil axis AX21 of the first coil conductor pattern L2*a* and the third coil conductor pattern L2*c* of the secondary coil and the coil axis AX22 of the second coil conductor pattern L1*b* of the primary coil are shifted in both of the X axis direction and the Y axis direction.

Preferably, the first axis AX1 and the second axis AX2 are substantially straight lines adjacent to each other and extending parallel or substantially parallel with each other. However, it is not necessary for the first axis AX1 and the second axis AX2 to be exactly parallel to each other, and the first axis AX1 and the second axis AX2 may also be approximately parallel to each other.

Due to the above-described configuration, in planar view from the first axis AX1 direction, large portions of the odd-numbered coil conductor patterns L1*a* and L1*c* of the primary coil and the even-numbered coil conductor pattern L2*b* of the secondary coil do not overlap with each other. In substantially the same manner, in planar view from the second axis AX2 direction, large portions of the odd-numbered coil conductor patterns L2*a* and L2*c* of the secondary coil and the even-numbered coil conductor pattern L1*b* of the primary coil do not overlap with each other. Therefore, stray capacitance occurring between the primary coil and the secondary coil is small, the self-resonant frequency of the high-frequency transformer can be adequately higher than an operation frequency (carrier frequency) band, and a frequency characteristic becomes substantially constant in the operation frequency band. In other words, a high-frequency transformer having a good high-frequency characteristic is provided.

Fourth Preferred Embodiment

Figure 8A:
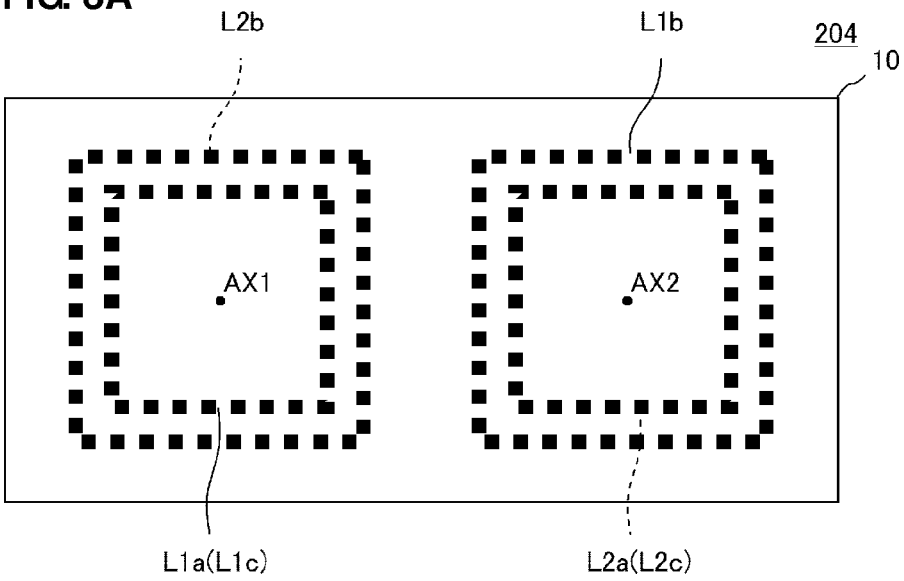
FIG. 8A is a schematic plan view of a high-frequency transformer of a fourth preferred embodiment of the present invention and a diagram illustrating a positional relationship between coil conductor patterns within a laminated body.
Figure 8B:
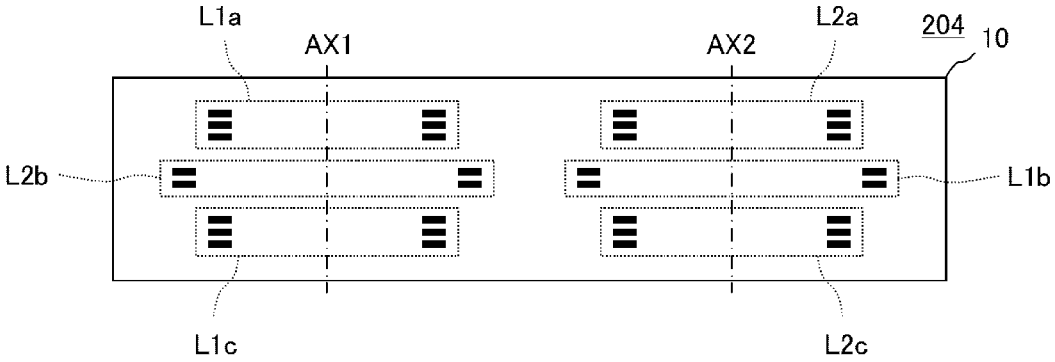
FIG. 8B is a cross-sectional view of the high-frequency transformer.

FIG. 8A is the schematic plan view of a high-frequency transformer 204 of a fourth preferred embodiment of the present invention and a diagram illustrating a positional relationship between coil conductor patterns within a laminated body. FIG. 8B is the cross-sectional view of the high-frequency transformer 204.

As illustrated in FIG. 8A and FIG. 8B, the coil axes of the first coil conductor pattern L1*a* and the third coil conductor pattern L1*c* of the primary coil and the second coil conductor pattern L2*b* of the secondary coil are a common first axis. In substantially the same manner, the coil axes of the first coil conductor pattern L2*a* and the third coil conductor pattern L2*c* of the secondary coil and the second coil conductor pattern L2*b* of the primary coil are a common second axis AX2. However, the circumferential sizes of the coil conductor patterns L1*a* and L1*c* are different from the circumferential size of the coil conductor pattern L2*b*. In substantially the same manner, the circumferential sizes of the coil conductor patterns L2*a* and L2*c* are different from the circumferential size of the coil conductor pattern L1*b*.

Due to the above-described configuration, in planar view from the first axis AX1 direction, large portions of the odd-numbered coil conductor patterns L1*a* and L1*c* of the primary coil and the even-numbered coil conductor pattern L2*b* of the secondary coil do not overlap with each other. In substantially the same manner, large portions of the odd-numbered coil conductor patterns L2*a* and L2*c* of the secondary coil and the even-numbered coil conductor pattern L1*b* of the primary coil do not overlap with each other. Therefore, in substantially the same manner as the high-frequency transformer illustrated in the third preferred embodiment, stray capacitance occurring between the primary coil and the secondary coil is small, the self-resonant frequency of the high-frequency transformer can be adequately higher than an operation frequency (carrier frequency) band, and a frequency characteristic becomes substantially constant in the operation frequency band. In other words, a high-frequency transformer having a good high-frequency characteristic is provided.

Fifth Preferred Embodiment

Figure 9:
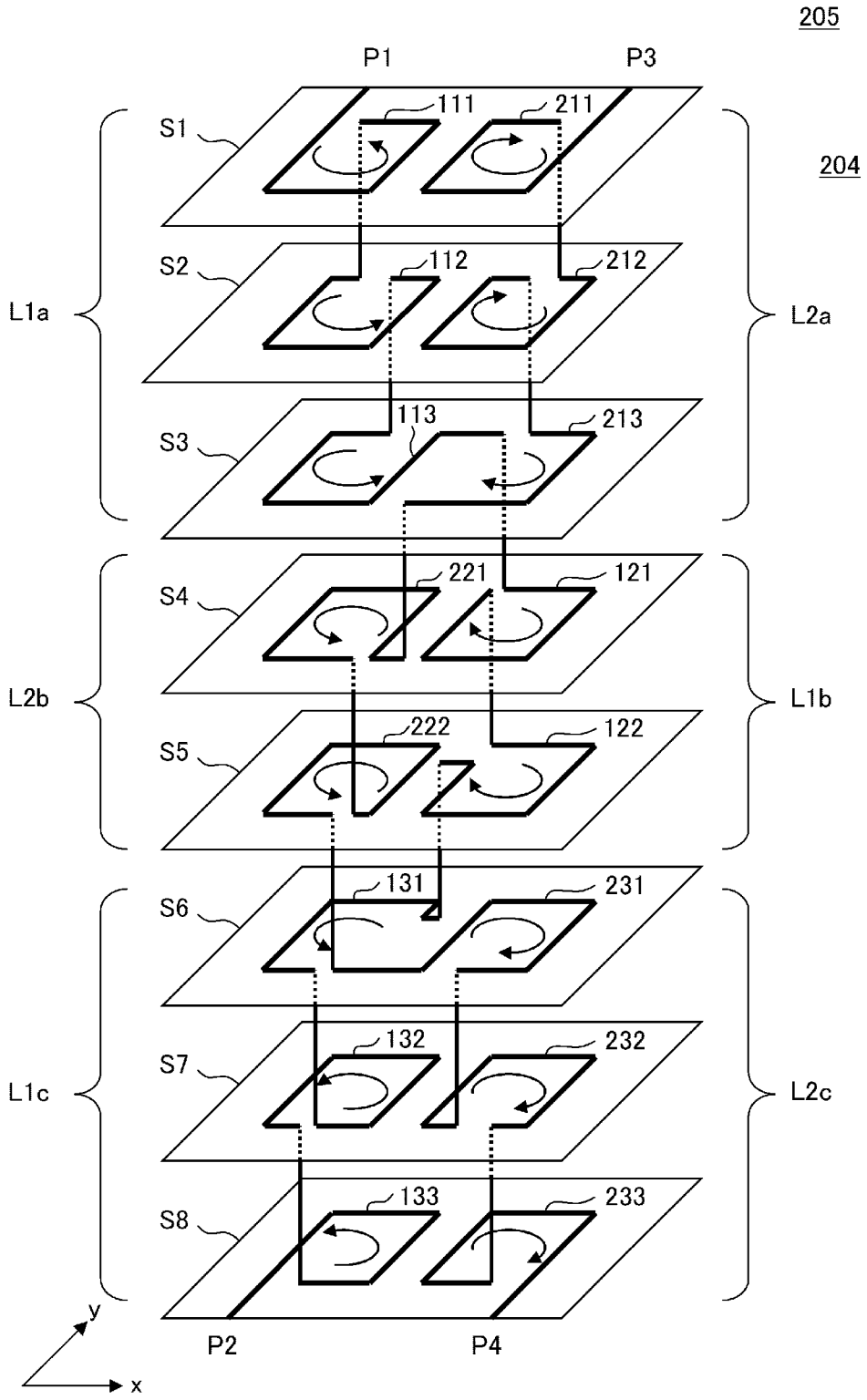
FIG. 9 is an exploded perspective view of a high-frequency transformer of a fifth preferred embodiment of the present invention.
Figure 10A:
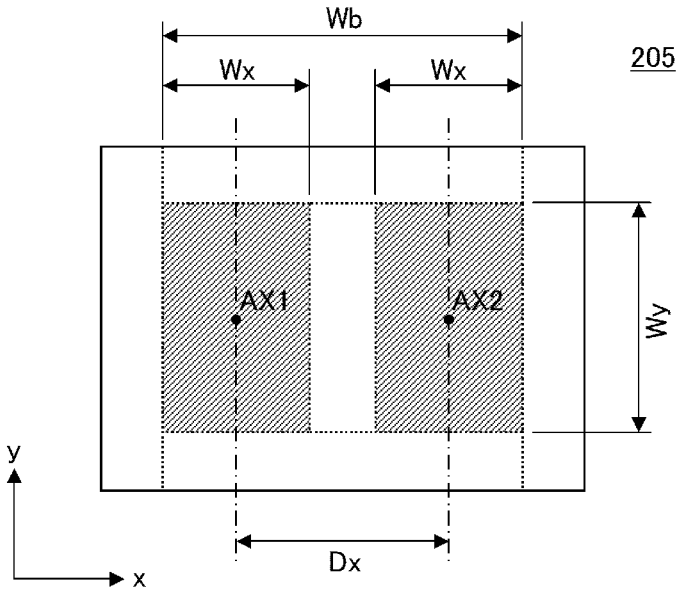
FIG. 10A is a schematic plan view of the high-frequency transformer and a diagram illustrating a positional relationship between coil conductor patterns within a laminated body.

FIG. 9 is the exploded perspective view of a high-frequency transformer 205 of a fifth preferred embodiment of the present invention. FIG. 10A is the schematic plan view of the high-frequency transformer 205 and a diagram illustrating a positional relationship between coil conductor patterns within a laminated body. In the high-frequency transformer 205, a primary coil and a secondary coil are provided in a laminated body including a plurality of base material layers S1 to S8 that are laminated to one another, and a plurality of conductor patterns provided in the laminated body.

The topology of conductor patterns 111 to 113, 211 to 213, 121, 122, 221, 222, 131 to 133, and 231 to 233 provided on base material layers S1 to S8, and via hole conductors extending in a vertical direction is the same or substantially the same as that illustrated in FIG. 1 in the first preferred embodiment. A ratio between a width in the x axis direction and a width in the y axis direction of each coil conductor pattern is preferably different. Specifically, when it is assumed that a direction of a distance between the first axis AX1 and the second axis AX2 is a first direction (x axis direction) and a direction approximately perpendicular to the first direction and approximately perpendicular to the lamination direction of the base material layers S1 to S8 is a second direction (y axis direction), a width in the first direction (x axis direction) of each coil conductor pattern is preferably less than a width in the second direction (y axis direction) thereof. In other words, a relationship of Wx<Wy, for example, is preferably satisfied.

Figure 10B:
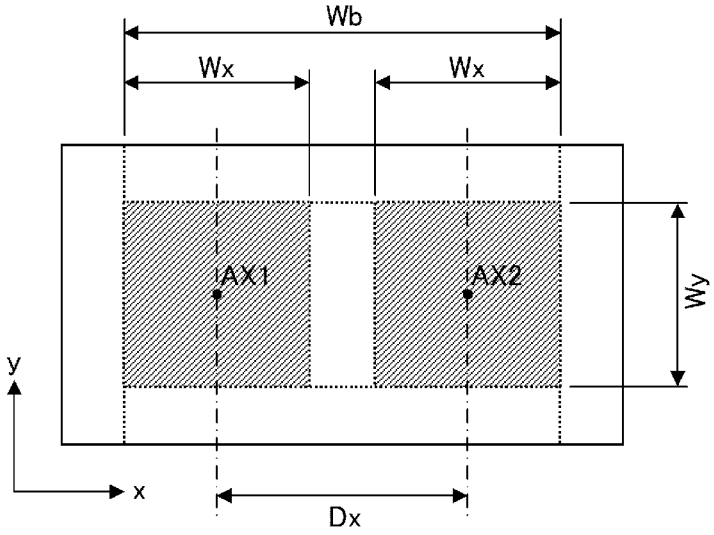
FIG. 10B is a schematic plan view of a high-frequency transformer (the high-frequency transformer illustrated in the first preferred embodiment of the present invention) as a comparative example and a diagram illustrating a positional relationship between coil conductor patterns within a laminated body.

FIG. 10B is the schematic plan view of a high-frequency transformer (the high-frequency transformer 201 illustrated in the first preferred embodiment) as a comparative example and a diagram illustrating a positional relationship between coil conductor patterns within a laminated body. In this comparative example, a width in the first direction (x axis direction) of each coil conductor pattern and a width in the second direction (y axis direction) thereof are approximately equal to each other. While substantially the same inductance may be obtained if the circumferential sizes (areas hatched in the drawings) of the individual coil conductor patterns illustrated in FIG. 10A and FIG. 10B are approximately equal to each other and the numbers of turns are approximately equal to each other, a total width Wb in the first direction (x axis direction) of the forming region of the coil conductor pattern is reduced if the relationship of Wx<Wy is satisfied as illustrated in FIG. 10A. Accordingly, a mounting area is relatively large when a substantially square shape is used, and the miniaturization of a chip size can be achieved when Wx<Wy is satisfied. In addition, since a distance Dx between the first axis AX1 and the second axis AX2 is reduced, the path of a magnetic flux passing in the first direction (x axis direction) is shortened, and a coupling coefficient between the primary coil and the secondary coil is significantly improved. While, in the comparative example illustrated in FIG. 10B, the coupling coefficient between the primary coil and the secondary coil is about 0.6 to about 0.7, the coupling coefficient between the primary coil and the secondary coil is about 0.8 to about 0.9 in the example illustrated in FIG. 10A.

Sixth Preferred Embodiment

While, in each of the preferred embodiments illustrated above, the coil conductor pattern defining the primary coil and the coil conductor pattern defining the secondary coil are preferably substantially point-symmetric (substantially rotationally symmetric with 180 degrees within a surface) and the numbers of turns of the primary coil and the secondary coil are preferably equal or approximately equal to each other, it is not necessary for a substantially point-symmetric shape to be provided, and a ratio between the numbers of turns may be arbitrarily set as necessary. The sixth preferred embodiment of the present invention illustrates an example thereof.

Figure 11:
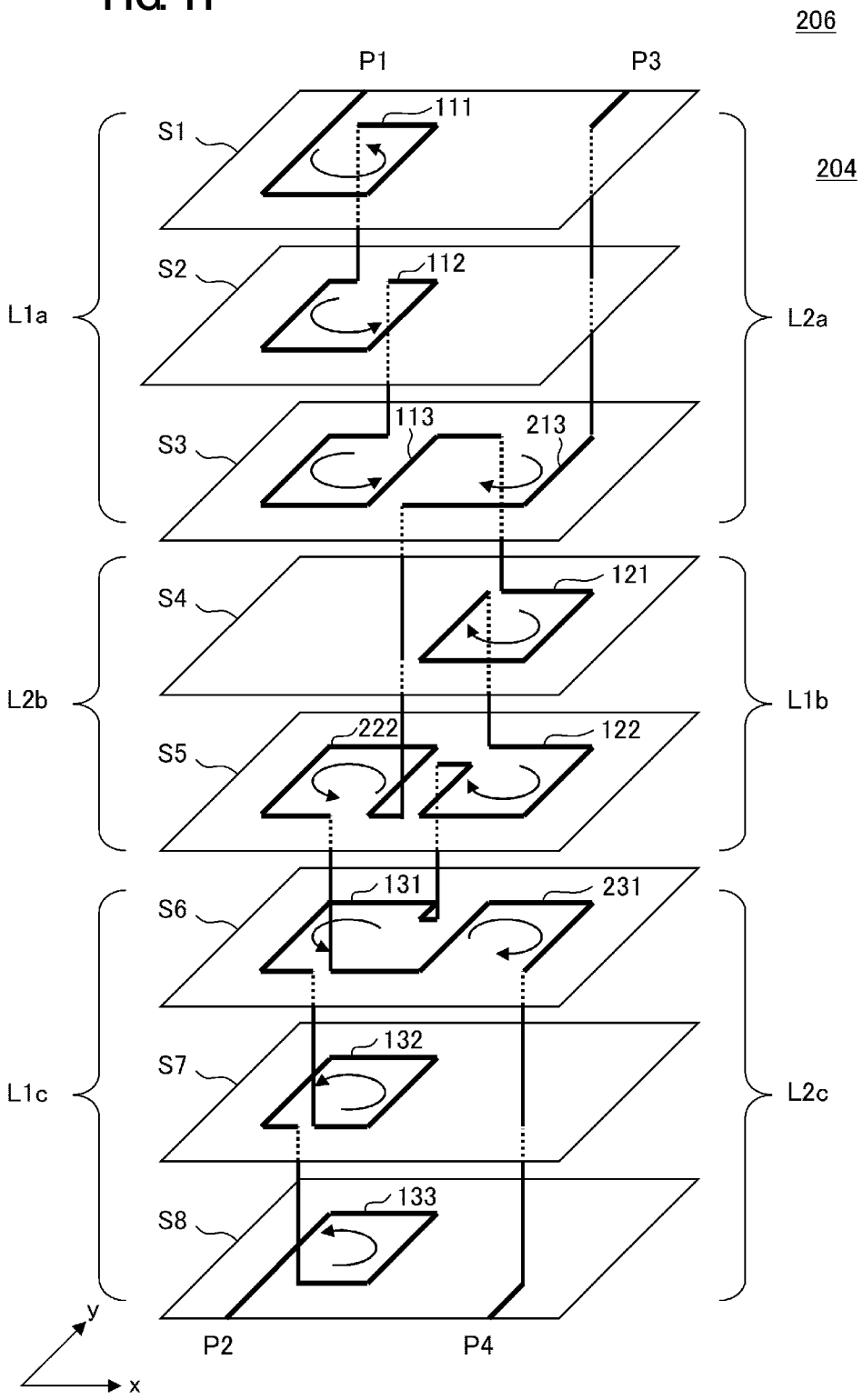
FIG. 11 is an exploded perspective view of a high-frequency transformer of a sixth preferred embodiment of the present invention.

FIG. 11 is the exploded perspective view of a high-frequency transformer 206 of a sixth preferred embodiment of the present invention. In the high-frequency transformer 206, a primary coil and a secondary coil are provided in a laminated body including a plurality of base material layers S1 to S8 that are laminated to one another and a plurality of conductor patterns provided in the laminated body.

As illustrated in FIG. 11, conductor patterns are provided on the base material layers S1 to S8. Conductor patterns 111 to 113 and 213 are provided on the base material layers S1 to S3. Conductor patterns 121, 122, and 222 are provided on the base material layers S4 and S5. Conductor patterns 131 to 133 and 231 are provided on the base material layers S6 to S8.

Dashed lines extending in a vertical direction in FIG. 11 denote via hole conductors, and connect conductor patterns to each other using interlayers.

Compared with the high-frequency transformer 205 illustrated in FIG. 9 in the fifth preferred embodiment, the high-frequency transformer 206 does not include the coil conductor pattern 211, 212, 221, 232, or 233 of the high-frequency transformer 205. A ratio between the numbers of turns of the primary coil and the secondary coil is preferably about 5.3:1, for example. The remaining configuration preferably is the same or substantially the same as that illustrated in the fifth preferred embodiment.

Seventh Preferred Embodiment

A seventh preferred embodiment of the present invention illustrates an antenna front-end module including the high-frequency transformer according to a preferred embodiment of the present invention and a communication terminal device including the antenna front-end module.

Figure 12:
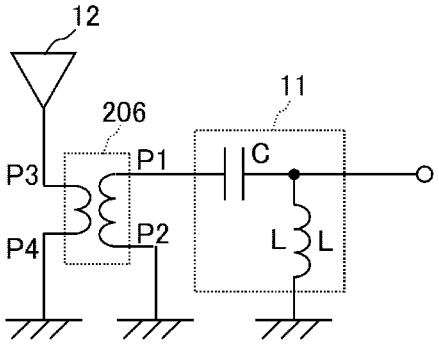
FIG. 12 is a circuit diagram of an antenna and an antenna front-end module.
Figure 13:
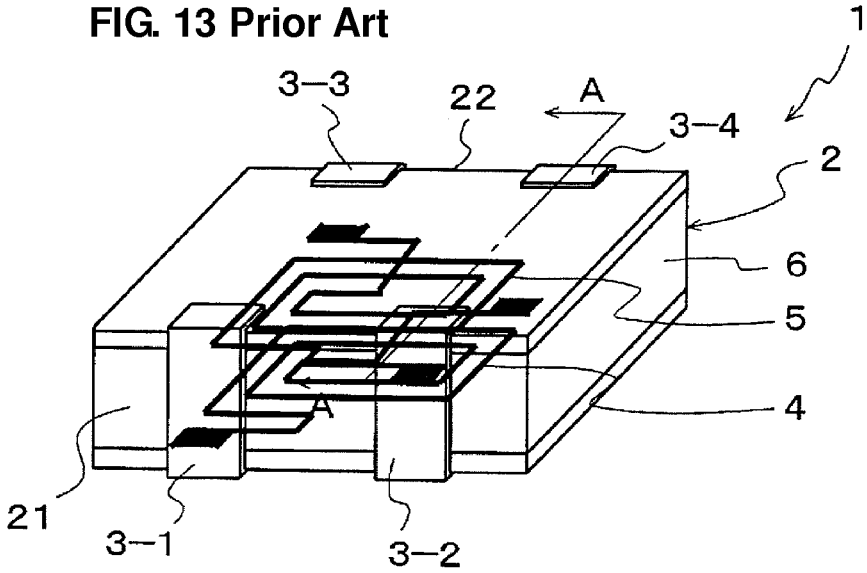
FIG. 13 Prior Art
FIG. 13 is a transparent perspective view of a laminated transformer illustrated in International Publication No. WO 2008/105213.

FIG. 12 is the circuit diagram of an antenna of a communication terminal device and an antenna front-end module connected to the antenna. In FIG. 12, the antenna front-end module preferably includes a high-frequency transformer 206 and a matching circuit 11. While being the high-frequency transformer 206 illustrated in the sixth preferred embodiment, the high-frequency transformer 206 is expressed by a symbol of a simple transformer. The matching circuit 11 is connected to the primary coil of the high-frequency transformer 206, and an antenna 12 is connected to the secondary coil thereof. A ratio between the numbers of turns of the primary coil and the secondary coil of the high-frequency transformer 206 is preferably about 5.3:1, for example. Preferably, the impedance of the antenna is, for example, about 5Ω, and impedance-converted into about 30Ω by the high-frequency transformer 206 (about 5 Ω×5.3≈30Ω), for example. The matching circuit 11 includes a shunt-connected inductor L and a series-connected C, and the matching circuit 11 achieves impedance matching between a transmission line whose characteristic impedance is about 30Ω, for example, and a transmission line whose characteristic impedance is about 50Ω, for example.

Accordingly, it may be possible for the antenna front-end module including the high-frequency transformer 206 and the matching circuit 11 to match the antenna 12 having low impedance of about 5Ω to a usual transmission line of a 50Ω system, for example.

In this manner, the high-frequency transformer according to preferred embodiments of the present invention may be used for an impedance converter circuit of a high-frequency band (for example, about 100 MHz to about 8 GHz).

In a compact communication terminal device, such as a mobile terminal, it is necessary to decrease the impedance of an antenna with the miniaturization of the antenna. However, with the above-mentioned antenna front-end module being provided in a communication terminal device, matching between a high-frequency circuit and an antenna can be achieved, and an antenna circuit having low reflection and a high efficiency can be provided.

While, as described above, the present invention has been described with respect to the specific preferred embodiments, the present invention is not limited to the above-described preferred embodiments.

While, in the first preferred embodiment illustrated in FIG. 1, an example has been illustrated in which the primary coil includes the three series-connected coil conductor patterns and the secondary coil includes the three series-connected coil conductor patterns, each of the primary coil and the secondary coil may also include four or more series-connected coil conductor patterns.

In addition, the number of turns of one coil conductor pattern is also not limited to that in each preferred embodiment described above. When it is assumed that the total number of turns is the same, if the number of turns per one coil conductor pattern is decreased and the number of odd-numbered conductor patterns and even-numbered coil conductor patterns is increased, a leakage flux is reduced. Therefore, a coupling coefficient between the primary coil and the secondary coil can be increased. However, since total stray capacitance that occurs at boundaries between the coil conductor patterns of the primary coil and the coil conductor patterns of the secondary coil becomes large, it is only necessary to define the number of turns per one coil conductor pattern and the number of odd-numbered and even-numbered coil conductor patterns so that the self-resonant frequency is greater than or equal to a predetermined frequency and the coupling coefficient is high.

In addition, it is not necessary for all of the individual coil conductor patterns of the primary coil and the secondary coil to be provided within the laminated body, and a portion thereof may also be provided on a surface of the laminated body.

In addition, each coil conductor pattern may also be a coil conductor pattern in which a coil conductor pattern including a plurality of turns is provided on a single layer or a coil conductor pattern in which a coil conductor pattern including a plurality of turns is provided on each of a plurality of layers, in addition to a laminated coil pattern in which a plurality of one-turn coils are laminated.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A high-frequency transformer comprising:

a laminated body including a plurality of base material layers that are laminated on one another; and a primary coil and a secondary coil including at least portions thereof that are embedded in the laminated body; wherein the primary coil includes an odd-numbered coil conductor pattern whose coil aperture that includes a first axis, and an even-numbered coil conductor pattern that is series-connected to the odd-numbered coil conductor pattern of the primary coil and whose coil aperture includes a second axis that is parallel or approximately parallel to the first axis of the primary coil;

the secondary coil includes an odd-numbered coil conductor pattern whose coil aperture includes the second axis and which is disposed adjacent to the odd-numbered coil conductor pattern of the primary coil, and an even-numbered coil conductor pattern which is series-connected to the odd-numbered coil conductor pattern of the secondary coil, whose coil aperture includes the first axis, and which is disposed adjacent to the even-numbered coil conductor pattern of the primary coil;

the odd-numbered coil conductor pattern of the primary coil, the even-numbered coil conductor pattern of the primary coil, the odd-numbered coil conductor pattern of the secondary coil, and the even-numbered coil conductor pattern of the secondary coil are wound such that when currents flow through the primary coil and the secondary coil, directions of a magnetic field occurring in the first axis and a magnetic field occurring in the second axis are opposite to each other;

the high-frequency transformer is configured to perform impedance conversion on a circuit connected to the primary coil and a circuit connected to the secondary coil; and the primary coil includes a different number of turns than the secondary coil.

2. The high-frequency transformer according to claim 1, wherein in planar view from a direction in which the first axis extends, at least portions of the odd-numbered coil conductor pattern of the primary coil and the even-numbered coil conductor pattern of the secondary coil do not overlap with each other; and in planar view from a direction in which the second axis extends, at least portions of the odd-numbered coil conductor pattern of the secondary coil and the even-numbered coil conductor pattern of the primary coil do not overlap with each other.

3. The high-frequency transformer according to claim 1, wherein when it is assumed that a direction of a distance between the first axis and the second axis is a first direction and a direction perpendicular or approximately perpendicular to the first direction and perpendicular or approximately perpendicular to a lamination direction of the base material layers is a second direction, widths in the first direction of the odd-numbered coil conductor pattern of the primary coil, the even-numbered coil conductor pattern of the primary coil, the odd-numbered coil conductor pattern of the secondary coil, and the even-numbered coil conductor pattern of the secondary coil are less than widths in the second direction thereof.

4. The high-frequency transformer according to claim 1, wherein all portions of each of the primary coil and the secondary coil are embedded in the laminated body.

5. The high-frequency transformer according to claim 1, wherein each of the odd-numbered coil conductor pattern of the primary coil, the even-numbered coil conductor pattern of the primary coil, the odd-numbered coil conductor pattern of the secondary coil, and the even-numbered coil conductor pattern of the secondary coil includes a single turn.

6. The high-frequency transformer according to claim 1, wherein each of the odd-numbered coil conductor pattern of the primary coil, the even-numbered coil conductor pattern of the primary coil, the odd-numbered coil conductor pattern of the secondary coil, and the even-numbered coil conductor pattern of the secondary coil includes a plurality of turns.

7. The high-frequency transformer according to claim 1, wherein the laminated body is one of a ceramic laminated body or a resin laminated body.

8. The high-frequency transformer according to claim 1, wherein each of the odd-numbered coil conductor pattern of the primary coil, the even-numbered coil conductor pattern of the primary coil, the odd-numbered coil conductor pattern of the secondary coil, and the even-numbered coil conductor pattern of the secondary coil are made of one of copper or silver.

* * * * *